US007246663B2

(12) United States Patent
Rose

(10) Patent No.: US 7,246,663 B2
(45) Date of Patent: Jul. 24, 2007

(54) POSITIVE ENGAGEMENT INDICATOR FOR WIRELINE FISHING OPERATIONS

(75) Inventor: Lawrence Charles Rose, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 50 days.

(21) Appl. No.: 10/863,093

(22) Filed: Jun. 8, 2004

(65) Prior Publication Data

US 2005/0269081 A1 Dec. 8, 2005

(51) Int. Cl.
*E21B 31/18* (2006.01)

(52) U.S. Cl. ..... 166/255.1; 166/301; 166/113; 294/86.26

(58) Field of Classification Search ..... 166/255.1, 166/255.2, 250.13, 301, 98, 113; 294/96.12, 294/86.26, 86.33, 86.18
See application file for complete search history.

(56) References Cited

U.S. PATENT DOCUMENTS 2,347,759 A * 5/1944 Wherry ..... 294/86.3
2,614,881 A * 10/1952 Holland ..... 294/86.29
2,657,752 A * 11/1953 Ballew et al. ..... 166/66.5
2,727,778 A * 12/1955 MacKnight ..... 166/66
3,020,079 A * 2/1962 Samol ..... 294/65.5
3,220,495 A * 11/1965 McLaren, Jr. ..... 175/45
3,393,002 A * 7/1968 Woolley ..... 294/86.23
3,905,634 A * 9/1975 Johnson et al. ..... 376/233
3,971,543 A * 7/1976 Shanahan ..... 254/134.3 R
4,488,747 A * 12/1984 Austin ..... 294/86.1
4,693,308 A * 9/1987 Luke et al. ..... 166/55.1
5,054,832 A * 10/1991 Davis et al. ..... 294/86.3
5,361,838 A * 11/1994 Kilgore ..... 166/254.2
5,361,844 A * 11/1994 Taylor et al. ..... 166/301
5,477,921 A * 12/1995 Tollefsen ..... 166/250.13
5,865,253 A * 2/1999 Gamper et al. ..... 166/301
5,984,009 A * 11/1999 DiFoggio ..... 166/250.13
6,333,699 B1 * 12/2001 Zierolf ..... 340/854.8
6,333,700 B1 * 12/2001 Thomeer et al. ..... 340/854.8
6,419,013 B1 * 7/2002 Milne et al. ..... 166/254.2
2003/0188869 A1 * 10/2003 Tinker ..... 166/301

FOREIGN PATENT DOCUMENTS

EP 0552087 A2 * 7/1993

* cited by examiner

*Primary Examiner*—David Bagnell
*Assistant Examiner*—Daniel P Stephenson
(74) *Attorney, Agent, or Firm*—Baker Botts L.L.P.

(57) ABSTRACT

A device and method for retrieving a tool string from downhole locations through the use of one or more engagement sensors. The one or more engagement sensors are activated by the tool string engaging an overshot device. The one or more engagement sensor may be mechanical, electric, or magnetic and may be located at various locations on the overshot device, the tool string, or both. Additionally, any number of engagement sensors may be used at the same time.

22 Claims, 12 Drawing Sheets

POSITIVE ENGAGEMENT INDICATOR FOR WIRELINE FISHING OPERATIONS

BACKGROUND OF THE INVENTION

The present disclosure relates to the field of borehole drilling for the production of hydrocarbons from subsurface formations. In particular, the present disclosure relates to fishing operations to recover tool strings.

An example of a fishing operation is the retrieval of a logging tool string that is stuck in a well. Logging tools may become stuck due to encounters with bridges, cave-ins, swelling formations, debris and the like. Often, an overshot device is used to enage the stuck tool string. During fishing operations, it is common practice to circulate mud or other substances down onto the stuck tools to clean the top of the fish that protrudes from the cable head of the tool string, and to determine when the overshot assembly engages the tool string. Typically, when the pump pressure increases, it is assumed that the pressure increase is due to the logging string being swallowed up by the fishing equipment overshot device. Currently, reconnecting the wireline during the fishing operation allows the logging engineer to monitor the down hole tension in order to determine when the drill string is pushing against the tool string and limit the weight that the driller puts down upon the tool string. In this way, the operator can recover the tool in a working condition and continue with the logging operation. It is important that the logging operation continue because the logging operation cost is based largely on the rig operation which is charged on an hourly basis and is generally quite expensive. Recovery of the tool reduces but does not eliminate the possibility that the tool string is dropped when the drill pipe is retrieved to the surface. The problem with the current state of affairs is that the tension increase that is seen by the logging engineer is only an indication that the drill string is pushing on the tool string. The tension increase is not, however, a complete indication that the overshot has actually swallowed the instrument itself or that the tool string is being engaged by the grapple within the overshot device. Instead, the tension increase could be the result of debris or other matter within the borehole itself that is preventing the instrument from being completely grappled by the overshot device.

If the tool string is not properly engaged by the grapple, the tool string may be dropped while the drill pipe is being retrieved to the surface. Unfortunately, dropping the tool string is a familiar occurrence during fishing operations. The weight of the logging tool string is light by comparison to the drill string, and therefore the driller often does not sense the weight of the logging tool string on his weight indicator because it is so small in comparison to the rest of the equipment. Moreover, once the tool string is engaged, circulation is generally impossible or only possible when a pump out sub is run for the express purpose of providing circulation after the fish is engaged. In many cases it is not recommended to circulate because the possibility exists that the fishing neck of the tool string is not properly engaged and the circulation can push the tool string out of the fishing equipment and be lost once again downhole. There is, therefore, a need in the art for some mechanism to ensure proper engagement with the tool string with the overshot device.

BRIEF DESCRIPTION OF THE DRAWINGS

A more complete understanding of the present disclosure and advantages thereof may be acquired by referring to the following description taken in conjunction with the accompanying drawings, wherein.

Figure 1:
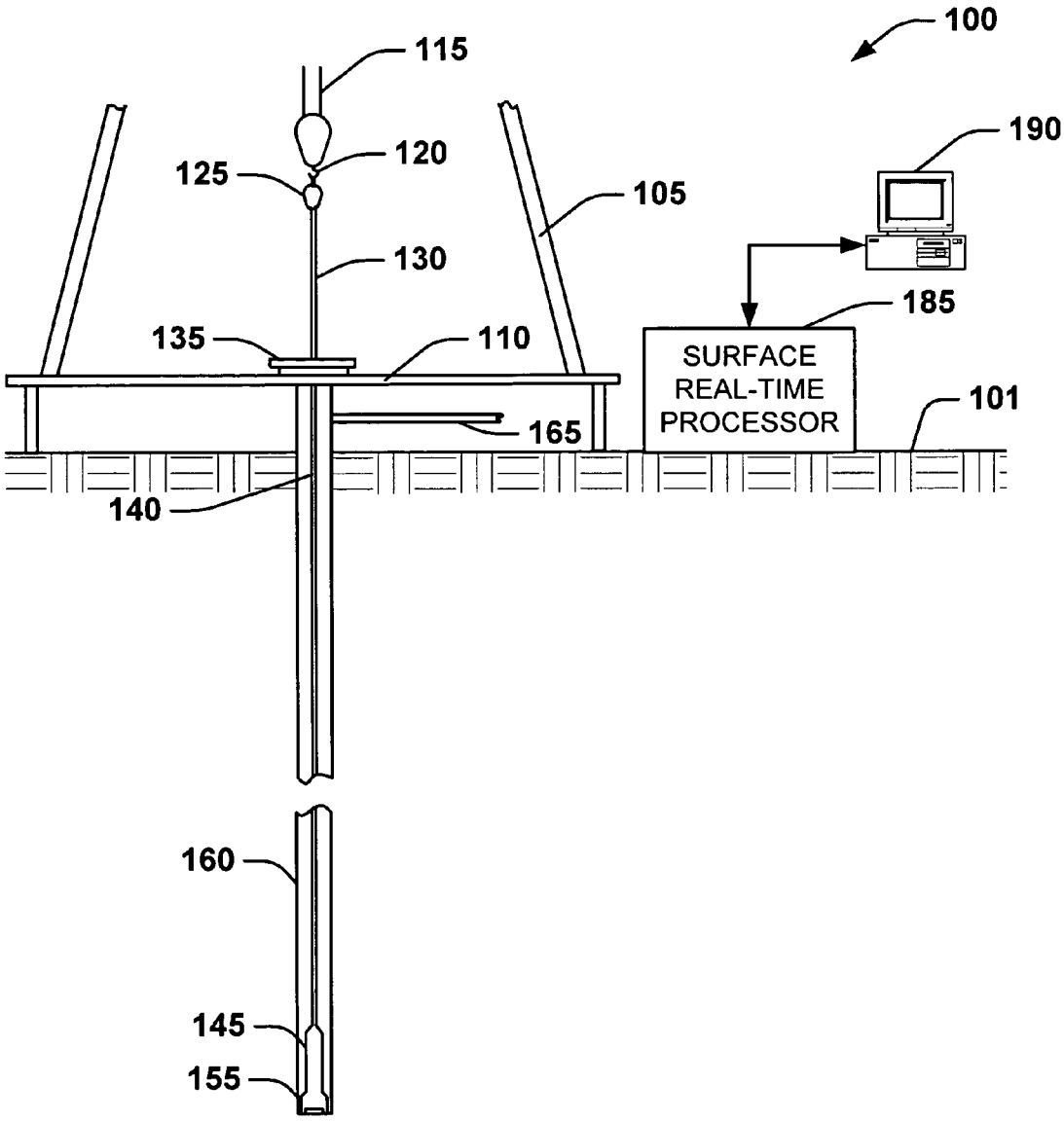
FIG. 1 is an illustration of a downhole operation for hydrocarbon production.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present disclosure illustrates how shortcomings of the prior art may be overcome by providing an engagement sensor or a mechanical device that can be placed in the cable head of a logging tool string and/or the fishing equipment to allow the logging engineer and/or the pump operator to monitor the fishing operation. The mechanical devices or sensors can be used as an indicator that the overshot device has indeed swallowed the tool string, and/or that the grapple is properly engaging the tool string. The sensor disclosed herein can be positioned and/or designed to allow the engineer or the driller to monitor the fishing grapple, the swallowing of the tool string at one or more points during the swallowing process. In other words, the sensors and mechanical devices disclosed herein can be enhanced further to measure the amount of the tool string that the overshot device may be actually swallowing at one or more points of the swallowing process.

The sensor disclosed herein can be a mechanical switch in the tool string that may be connected to a resistor or to a variable resistor to indicate the portion of tool string that may be being swallowed by the overshot device. In an alternate embodiment, the sensor could be a Hall effect sensor in the logging tool that indicates the increased presence of metal around the tool string body. In yet another alternate embodiment of the present disclosure, a mechanical setup may be designed such that when the overshot device swallows the tool string to the proper point, a switch or other mechanical device that may be fixed in the fishing equipment opens a circulation port that will cause the mud pumps to pulse or to exhibit some other significant fluctuation in pressure that may be detectable by the operator which will provide a positive indication to the operator that he has properly engaged the tool string. In yet another embodiment, an enhancement can be made to a hydro timer that, after a given time frame, would turn off the pulsing or other significant change mentioned previously, which can be interpreted as a further indication (or lack thereof) that the desired action has transpired.

If the sensor in the tool string may be connected to a resistor or to a variable resistor, then the conductor within the wireline that the resistor may be in line with can be monitored with a meter on the surface so that the monitoring may be both safe and easy. Such an embodiment would be preferable to monitoring with a computer, either downhole or remotely, such as during the retrieval of a non-detonated perforating device. Such an embodiment would also provide the ability to monitor the operation on the rig floor without reconnecting the wireline. Finally, if a mechanical device is placed in the fishing equipment (such as the overshot device), the mechanical device can be used to fish for the tool string in situations where the wireline has been removed in order to speed the fishing operation, such as in Cased Hole operations.

Other advantages of the method, system and apparatus disclosed herein include two or more or a combination of the following: (1) an increased level of safety; (2) for situations where the tool may be reconnected electrically, there will be the ability to monitor the downhole tension reading if the tension capability may be included in the logging tool string; (3) sensor data or a positive indication of engagement may be provided in real time; (4) positive indication of engagement of the logging tool string may be transmitted to and/or monitorable on the surface, thereby eliminating guesswork as to whether or not the overshot device may be swallowing the logging tool string rather than simply pushing on the sides or the top of the tools; (5) there may be a decreased possibility of dropping the tool string while retrieving the drill pipe to the surface; (6) no tension increase or decrease may be required to engage the tool string as there may be a positive indication that the overshot device and the tool string are engaged—which will decrease the possibility of accidentally breaking the weak point in the string; (7) the decreased tension that may be required to engage the tool string made possible with the system disclosed herein will also reduce the damage to the logging tools that are incurred during the fishing operation, thereby prolonging tool life; (8) apparatus disclosed herein will also allow fishing equipment to be designed for better circulation capabilities, before and after engagement as the pressure increase and circulation loss will no longer be required to confirm that the overshot has properly swallowed the tool string; therefore, the circulation can be used for other purposes such as evacuation from the hole and other applications. The apparatus disclosed herein is in stark contrast to the current state of the art where circulation is limited after the overshot has swallowed the tool unless a pump out sub is incorporated into the fishing equipment. Embodiments disclosed herein obviate the need for the pump out sub.

An explanation of the problem solved by the apparatus and methods described herein can begin with an illustration of the basic equipment used in downhole operations. As shown in FIG. 1, oil well drilling equipment 100 (simplified for ease of understanding) includes a derrick 105, derrick floor 110, draw works 115 (schematically represented by the drilling line and the traveling block), hook 120, swivel 125, kelly joint 130, rotary table 135, drill string 140, drill collar 145, and drill bit 155. Mud is injected into the swivel by a mud supply line (not shown). The mud travels through the kelly joint 130, drillpipe 140, and drill collars 145, and exits through jets or nozzles in the drill bit 155. The mud then flows up the annulus between the drill string and the wall of the borehole 160. A mud return line 165 returns mud from the borehole 160 and circulates it to a mud pit (not shown) and back to the mud supply line (not shown). The combination of the drill collar 145, and drill bit 155 is known as the bottomhole assembly (or "BHA"). In rotary drilling the rotary table 135 may provide rotation to the drill string, or alternatively the drill string may be rotated via a top drive assembly. The term "couple" or "couples" used herein is intended to mean either an indirect or a direct connection. Thus, if a first device couples to a second device, that connection may be through a direct connection, or through an indirect electrical connection via other devices and connections. Other equipment on the surface 101 may include a real-time processor 185 that can receive and process signals emanating from equipment downhole. Additional equipment, such as the computer 190 can be coupled to the surface real-time processor 185 in order to compute and/or display results of the information gathered downhole.

It will be understood that the term "oil well drilling equipment" or "oil well drilling system" is not intended to limit the use of the equipment and processes described with those terms to drilling an oil well. The terms also encompass drilling natural gas wells, water wells, geothermal wells, or mineral evaluation wells and/or hydrocarbon wells in general. Further, such wells can be used for production, monitoring, or injection in relation to the recovery of hydrocarbons or other materials from the subsurface.

Figure 1A:
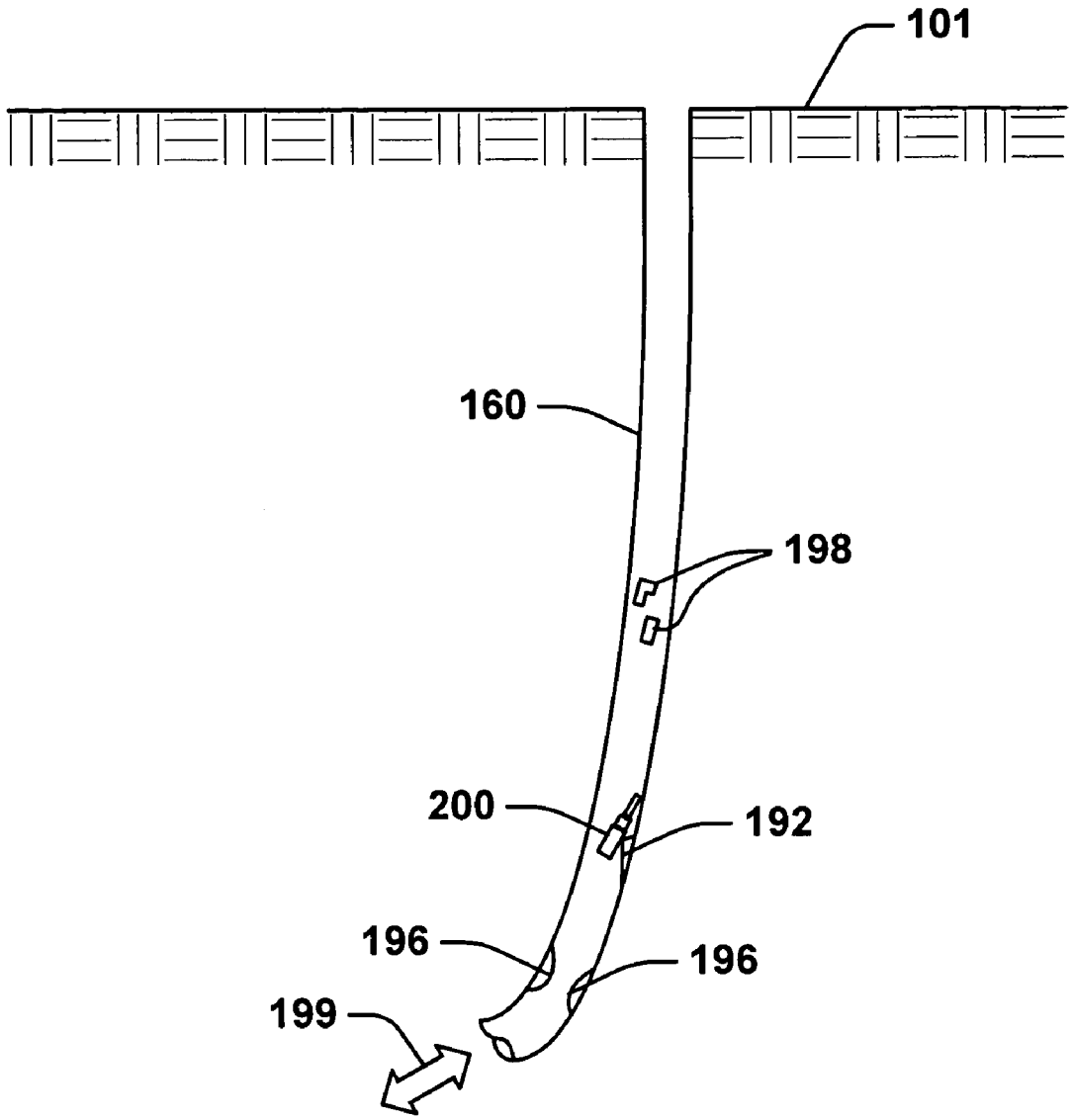
FIG. 1*a* is an illustration of a tool string that has become stuck or lost downhole.

Through accident or calamity, a tool string 200 (as well as the wireline) may become stuck or lost downhole. FIG. 1*a* illustrates a tool string 200 that has been caught on a ledge 192 within a borehole 160. Other perils for the tool string 200 are things such swelling clay 196 and debris 198. Finally, high-pressure fluid flows 199 from or into the formation can cause fluid, debris and tool strings 200 to be buffeted within the borehole 160.

There are generally four ways that a tool string and/or a wireline can become stuck in a well. First, the tool string may become stuck in a bridge, a cave-in, or swelling formation. Second, the tool string may become stuck at a key seat where the tools, or most likely, the wireline digs into the formation. This latter scenario usually occurs when the well is kicked off or deviates dramatically in a soft formation. A third scenario where a tool string may become stuck is when there is a difference in pressure between the well bore and the formation. The pressure difference occurs when the pressure from the well bore is trying to force the fluid out into the formation, and this may trap either the tools or the wireline by forcing them up against the side usually in a depleted zone that is permeable. A fourth way that the tool string 200 may become stuck is when the downhole tools or an accessory become hung up on a ledge or the bottom of the casing or tubing. Closing the calipers in the tool string may help in this situation, but that technique may not be successful.

In an open hole, the following conditions can cause the tool or cable to become stuck: debris on the well bottom; mechanical keyseating of the cable at a dogleg in the borehole; split or damaged casing shoe; knotted, birdcaged, or broken cable strands; differential pressure acting on the cable, bridle, tool, or possibly all three, especially across depleted zones; and/or restricted hole size or bridge in the borehole can cause the toolstring to become wedged at the head.

In a cased hole, the following conditions can cause the tool or cable to become stuck: collapsed or damaged pipe; entry into a reduced pipe size; soft cement; sand flow; excessive logging speeds for hole conditions; tool size exceeding limitations for casing size or conditions; differential pressure sticking opposite perforations or casing; leaks; knotted, birdcaged, or broken cable strands; debris in the well; cable damage by the upthrust of a perforating gun or head resulting from detonation in low hydrostatic pressure; and/or wedging into packers, plugs, and landing nipples.

The most common problem for fishing in an open hole is when depleted reservoirs "suck" the tools or wireline into the side due to the differential pressure between the borehole and the formation. This can also occur when equipment employs very heavy drilling mud and the borehole is over pressured in comparison to the formation pressure.

In a cased hole, the most common reason for tools and wirelines becoming stuck is through tubing perforating jobs, where the gun swells or deforms and the gun cannot get back into the bottom of the tubing.

Figure 2:
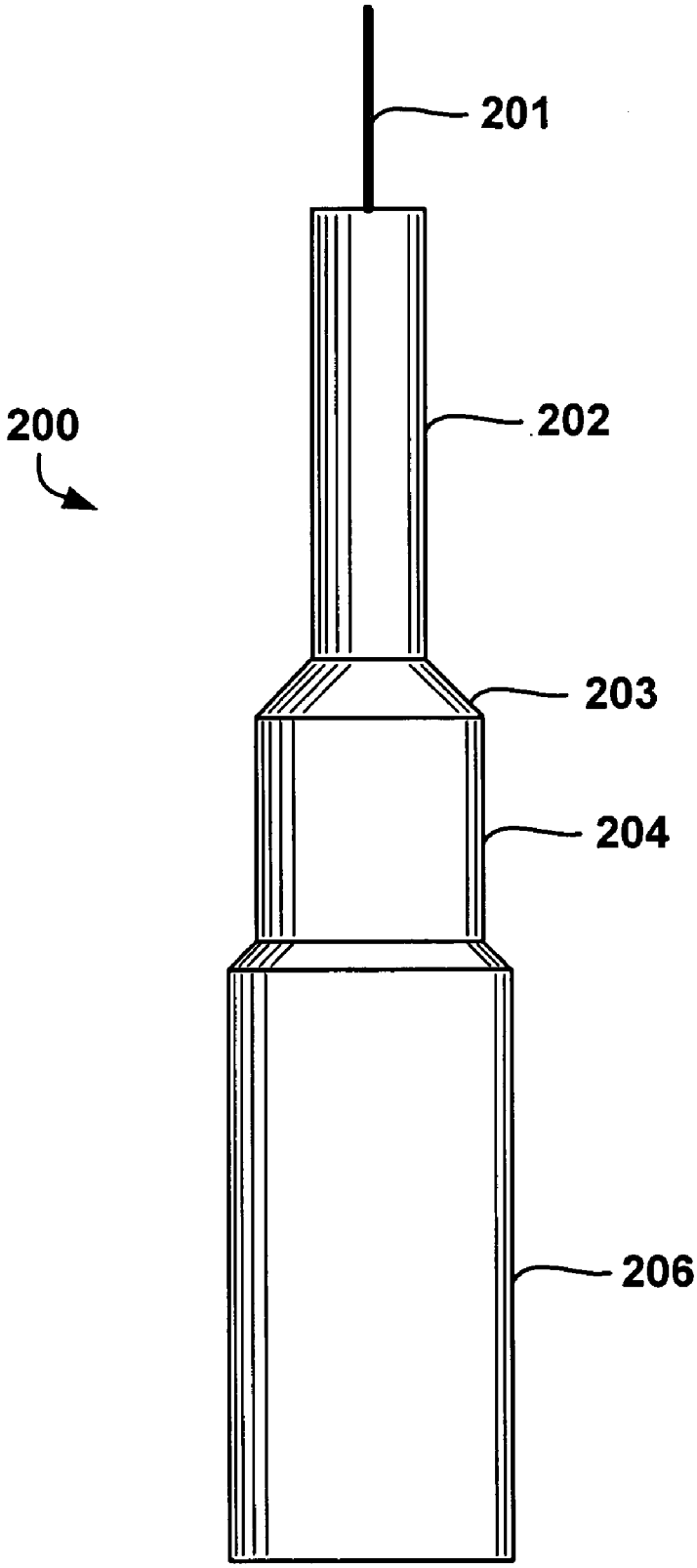
FIG. 2 illustrates a tool string.

A typical logging tool string may be illustrated in FIG. 2. The tool string 200 can be composed of three main segments. The first segment can be the instrument 206, which can contain any number of sensors and/or instruments for measuring downhole (or anywhere along the hole). The second segment can be the cable head 204, which can be positioned between the instrument 206 and the fishing neck 202. The fishing neck 202 may (or may not if it has been removed) have a cable line 201 that runs from the tool string 200 to the surface 101. In typical tool strings 200, there is a tapered shoulder 203 between the fishing neck 202 and the cable head 204, as illustrated in FIG. 2. Although the shoulder 203 is shown as tapered, non-tapered shoulders can be used with the appratus contemplated herein.

The instrument 206 typically (although not always) has the largest outside diameter ("o.d.") of any of the segments. The o.d. of the tool string 200 may be the defining factor in selecting the inside diameter ("i.d") of the overshot device 300, because in many cases, it can be desirable for at least part of the tool string 200 to fit within the overshot device 300, and thus the i.d. of the overshot device 300 should be large enough to accommodate the o.d. of the portion of the tool string 200 that is expected to be swallowed by the overshot device 300. If it is desirable for the overshot device 300 to swallow part of the tool string 200, then the length of the overshot device 300 should be long enough to accommodate the length of the tool string 200 to be swallowed. The i.d. of the borehole 160 may limit the o.d. of the overshot device 300, which may limit the part of the tool string 200 that can be swallowed by the overshot device 300 up to the cable head 204 or up to the fishing neck 202.

Figure 3:
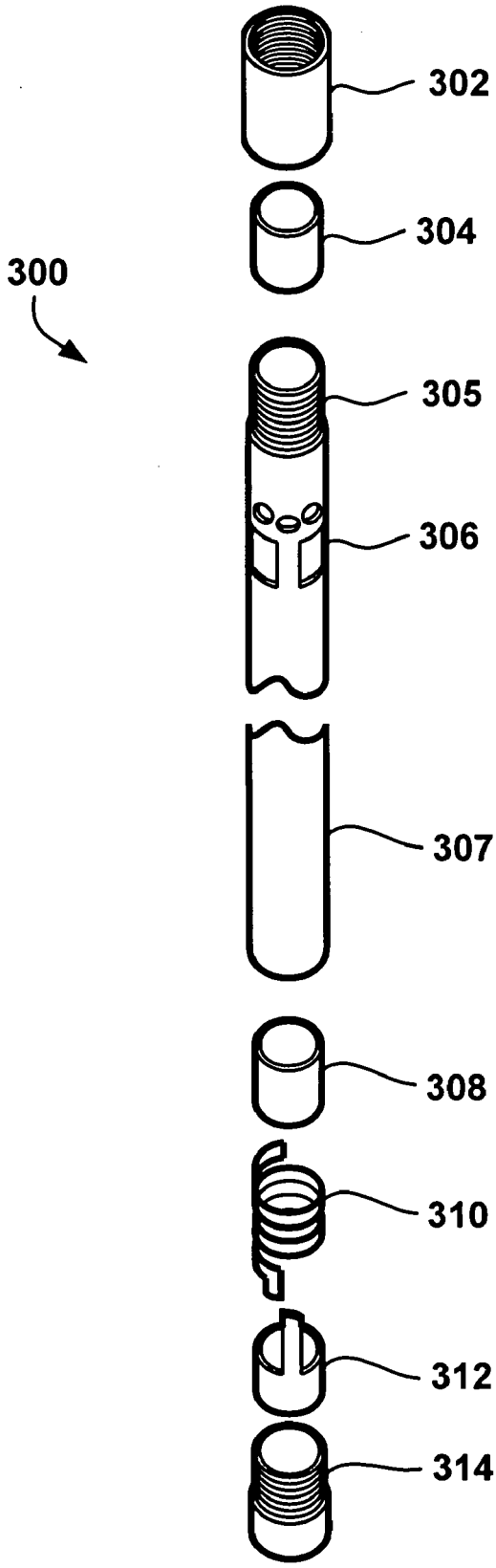
FIG. 3 is an exploded diagram of a overshot device.

An overshot device can be illustrated in FIG. 3. The overshot device 300 can contain one or more parts, as illustrated in FIG. 3. In this illustrative example, the overshot device 300 can be composed of a top sub 302, a bushing 304, a bowl 306 that has a distal end 305 that can be threadably engaged with the top sub 302, although other types of engagement is besides threading is possible. Within the postal end 307 of the bowl 306 are placed a packer seat ring 308, a grapple 310 (used to retain the tool string 200), a grapple control 312 (used to activate or deactivate the grapple 310), and a guide 314. In operation, the bottomhole assembly (FIG. 1) can be removed and may be replaced by the overshot device 300. The overshot device 300 can be oriented so that the guide 314 can be used to guide the fishing neck 202 into the overshot device 300 during the fishing operation. In many cases, the overshot device 300 can be hollow to allow the cable 201 to run contiguously from the tool string 200 to the surface 101. Moreover, the overshot device 300 has a hollow section at one end (in proximity to the grapple 310) to accommodate the tool string 200.

Figure 4:
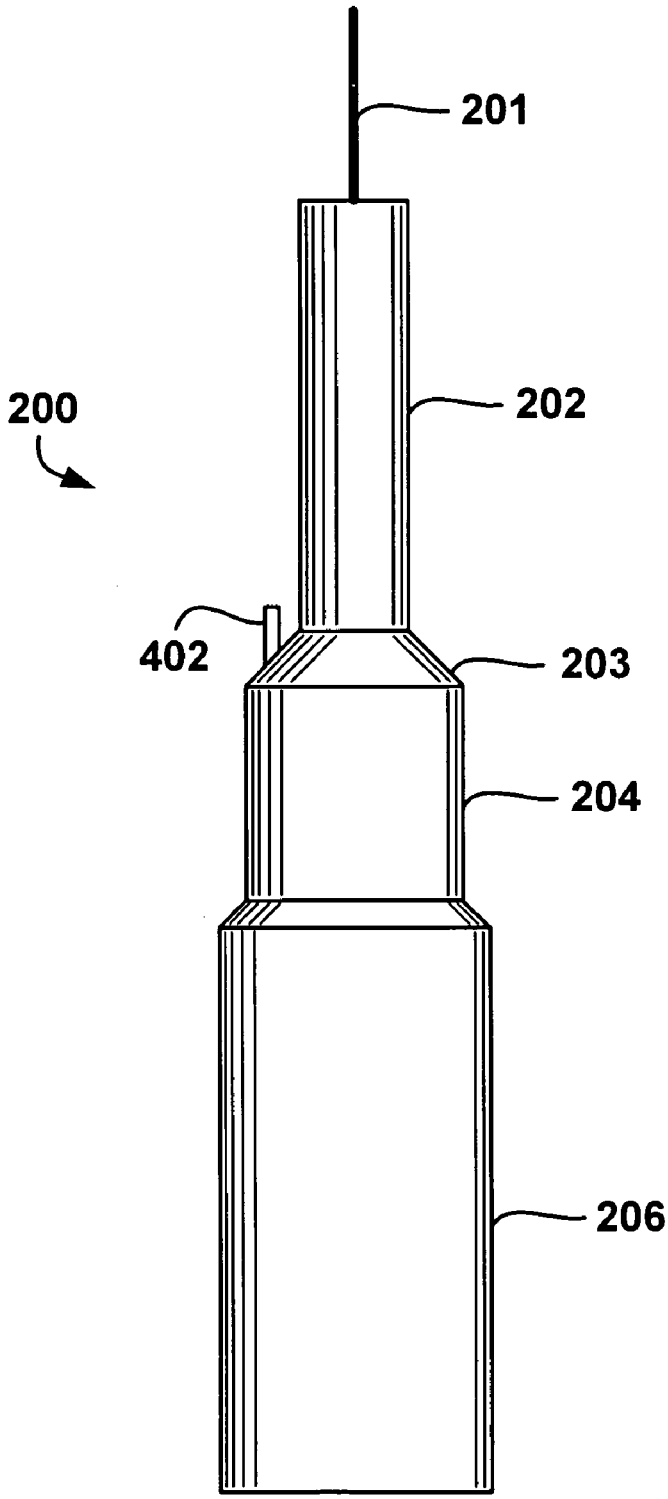
FIG. 4 illustrates a tool string with an embodiment of the sensor according to the teachings of the present disclosure.

FIG. 4 illustrates an embodiment of the present disclosure. This embodiment of the tool string 200 includes a sensor 402. The sensor 402 can be a mechanical switch that engages an internal shoulder of the overshot device 300 when the tool string 200 can be swallowed to the desired amount. When the sensor 402 is depressed (by the shoulder within the overshot device 300), a signal can be passed up through the wire cable 201 to the operator on the surface to inform him that the tool string 200 is properly engaged within the overshot device 300.

Figure 5:
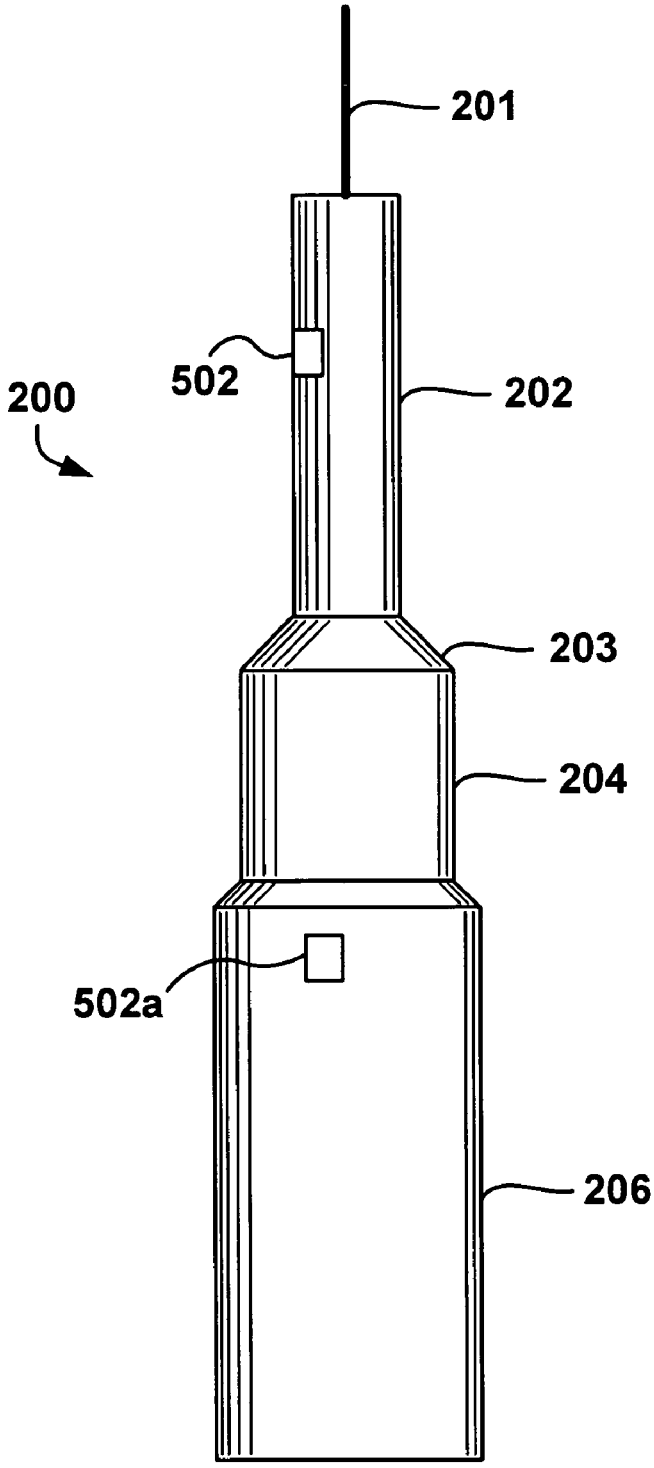
FIG. 5 illustrates a tool string with an embodiment of the sensor according to the teachings of the present disclosure.

FIG. 5 illustrates an embodiment of the present disclosure. The embodiment of FIG. 5 has the sensor 502 on the fishing neck 202. The sensor 502 in this embodiment can be a Hall effect sensor that indicates the presence of metal around the tool string 200. The sensor 502 has the advantage of being able to be placed flush with the local surface of the local tool string 200 so that debris (or another part of the overshot device 300) do not prematurely trip the sensor 502 as may happen with the sensor 402. Moreover, the sensor 502, because it can be flush-mounted, may be placed anywhere along the tool string 200. For example, the sensor 502*a* can be placed within of the tool string 200, and would only be triggered (provide a positive indication) if the tool string 200 were swallowed to a particular point by the overshot device 300. Similarly, multiple sensors 502 could be mounted onto the tool string 200 along the fishing neck 202, the shoulder 203, the cable head 204 and the instrument 206 to provide a better indication to the operator of the progress of the fishing operation (as sequential sensors would provide positive indications as the overshot device 300 swallows the tool string 200. As with the previous embodiment, the sensors 502 can send their positive (or negative) indicator signals through the cable 201 to, for example, the computer 190 for processing and display to the operator.

Figure 6:
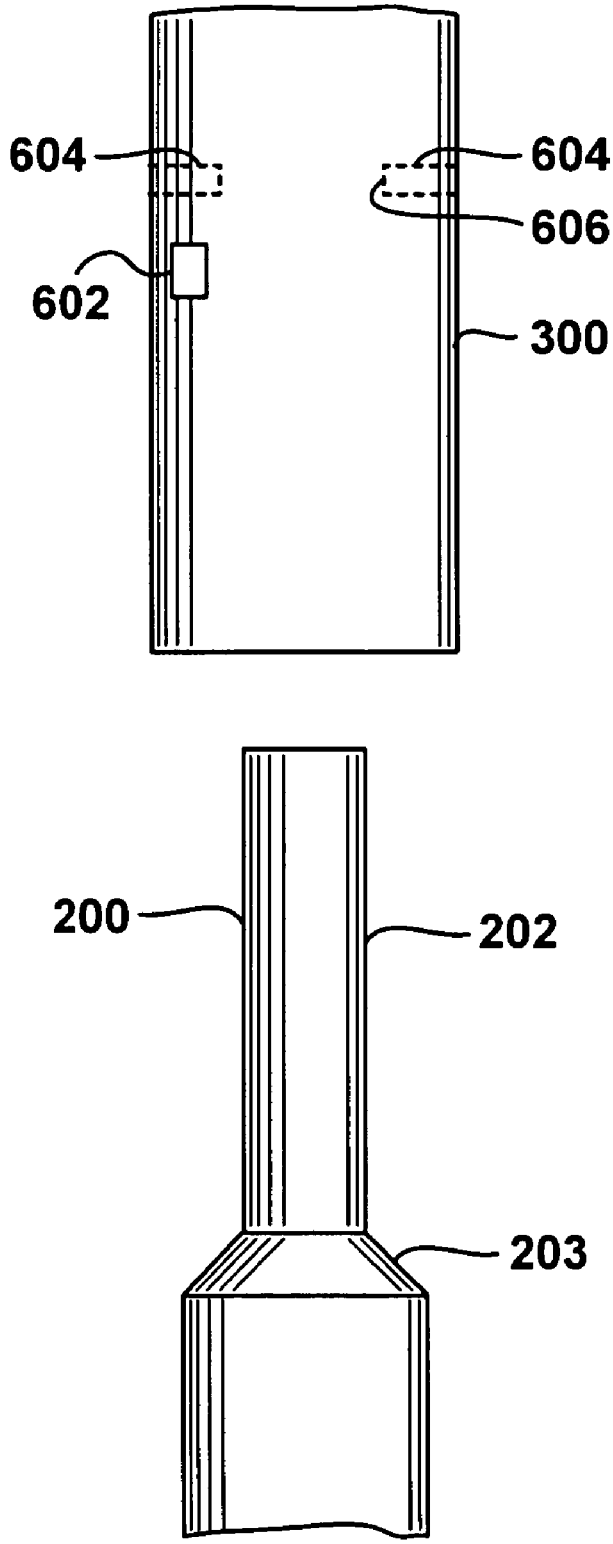
FIG. 6 illustrates an overshot device with an embodiment of the sensor according to the teachings of the present disclosure.

FIG. 6 illustrates an embodiment where a valve 602 can be placed on the overshot device 300. The valve 602 allows the circulation (of mud, etc.) from the overshot device 300 to the downhole environment. Moreover, the valve 602 can be positioned in proximity to the shoulder 604 of the overshot device 300. When the tool string 200 is brought up into the overshot device 300, the fishing neck can be pulled through the orifice 606 of the shoulder 604 until the shoulder 203 of the tool string 200 engages the shoulder 604 of the overshot device 300. A mechanical setup on the overshot device 300 and/or the tool string 200 can be provided to activate when the overshot device 300 swallows the tool string 200 to the proper point (such as when the shoulders 203 and 604 engage). Upon activation, a switch or other mechanical device that can be fixed in the fishing equipment opens a circulation port 602 that will cause the mud pumps (not shown) to pulse or to exhibit some other significant fluctuation in pressure that can be detectable by the operator. Depending upon how the circulation pulse is arranged, the valve 602 may be opened (to relieve the pressure of the circulation pulse that can no longer exit because of the presence of the tool string 200), or closed (because the circulation pulse can no longer exit the overshot device 300 via the orifice 606). The open or closed position of the valve 602 can be detected and an appropriate signal sent toward the surface 101 for processing and/or display to the operator. The pulse or fluctuation in pressure can provide a positive indication to the operator that he has properly engaged the tool string 200.

Figure 7:
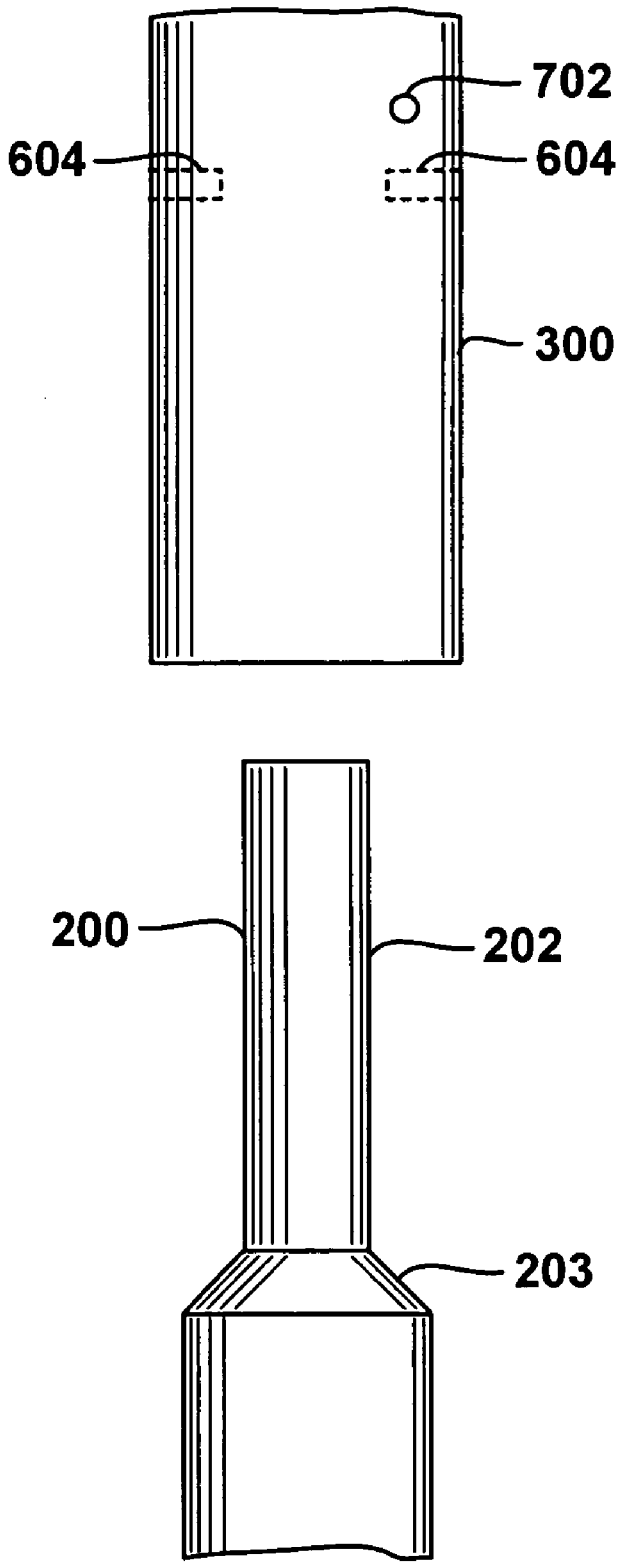
FIG. 7 illustrates an overshot device with an embodiment of the sensor according to the teachings of the present disclosure.

FIG. 7 illustrates an embodiment of the overshot device 300 that can be fitted with a circulation port 702. The circulation port 702 can, in one embodiment, be fitted with a membrane. The membrane acts as a safety valve. When the tool string 200 is swallowed by the overshot device 300 (to the point where the shoulders 203 and 604 engage), then the circulation fluid driven through the overshot device 300 can be trapped, with a corresponding pressure increase within the overshot device 300. The pressure increase may be detectable by instruments within the overshot device 300. Moreover, the membrane of the circulation port 702 can be constructed and arranged to burst at a predesignated pressure that may also be detected by instruments within the overshot device 300. Appropriate signals corresponding to the pressure measurements may be sent to the surface 101 for processing and/or display to the operator.

Figure 8:
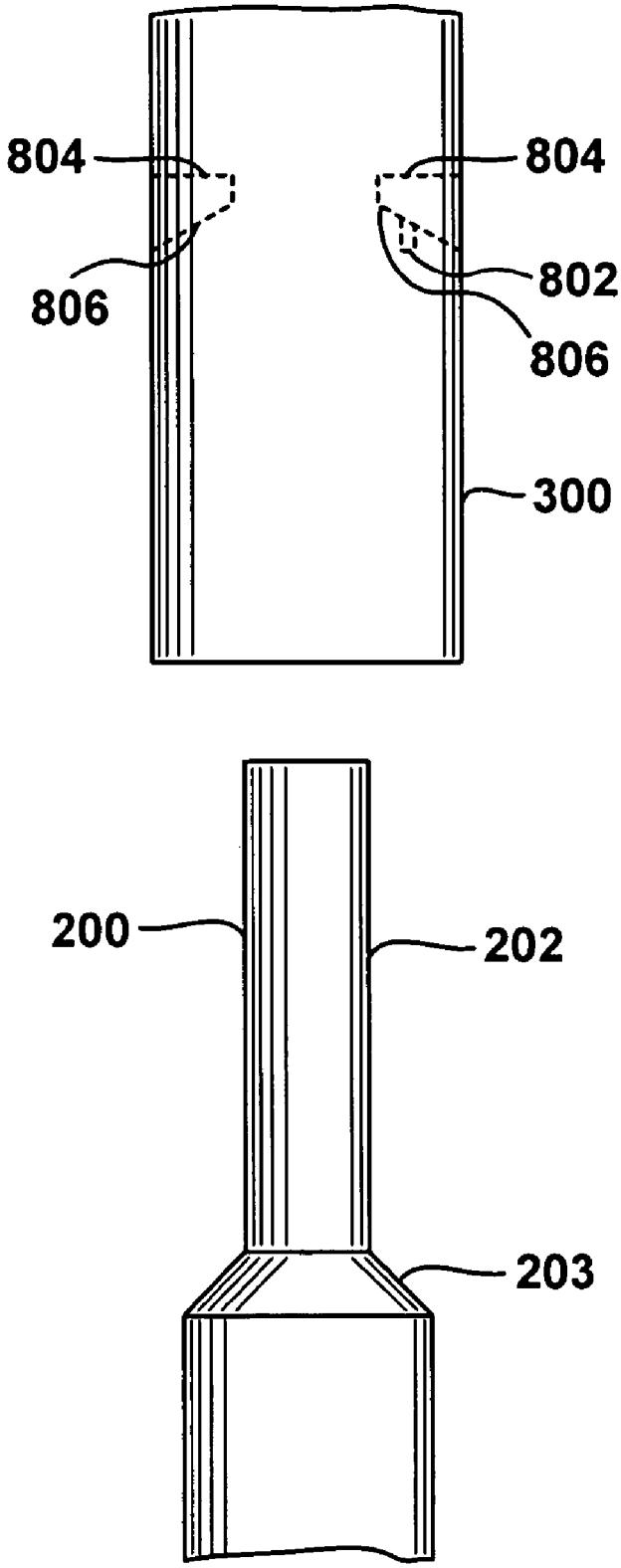
FIG. 8 illustrates an overshot device with an embodiment of the sensor according to the teachings of the present disclosure.

FIG. 8 illustrates an embodiment where a sensor 802 can be placed onto the engagement side 806 of the shoulder 804. In this embodiment, the sensor 802 can be engaged when the shoulder 203 of the tool string 200 can be engaged with the engagement side 806 of the shoulder 804, the sensor 802 is depressed, which can trigger an appropriate signal to the surface 101 for monitoring by the operator. In one embodiment, the sensor 802 can be a mechanical switch. In another embodiment, the sensor 802 can be, for example, a Hall effect sensor, that can be triggered for positive indication only when the proximity of the shoulder 203 of the tool string 200 can be within a preselected tolerance. Other types of sensors 802 can be used with equal effect so long as they provide a positive (or negative) indication of the presence of the tool string 200.

Figure 9:
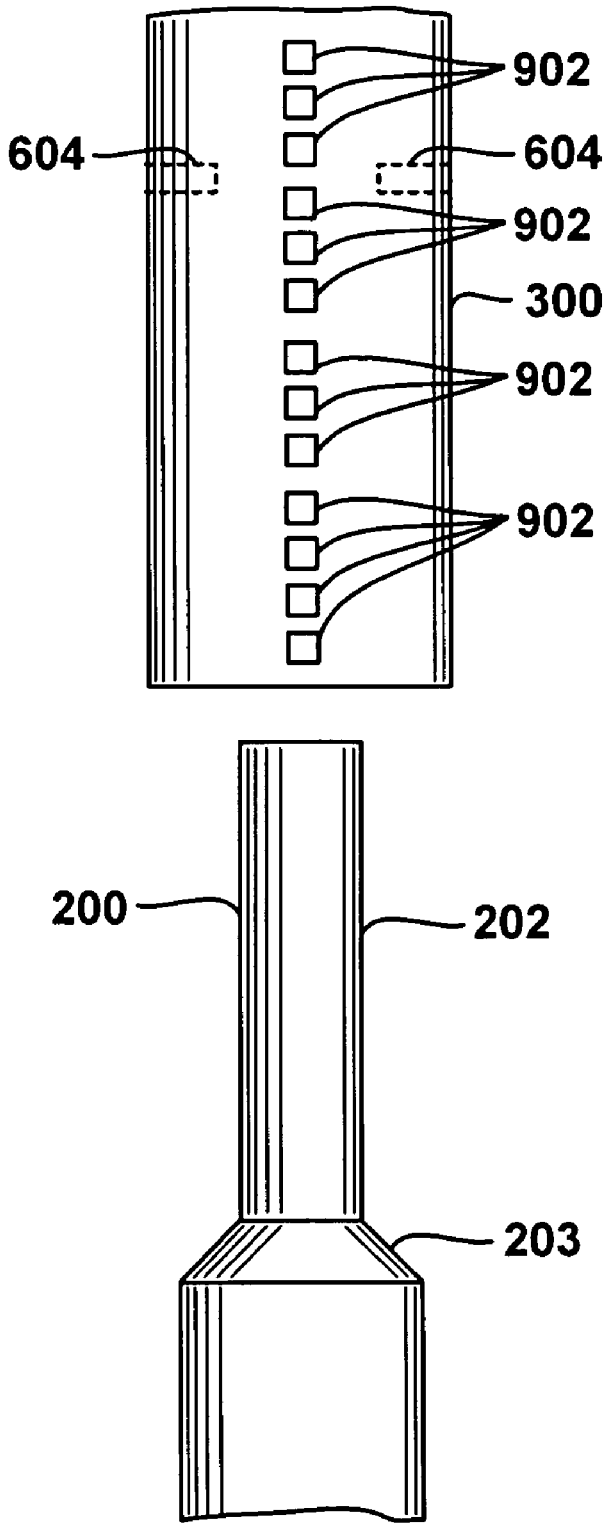
FIG. 9 illustrates an overshot device with an embodiment of the sensor according to the teachings of the present disclosure.

FIG. 9 illustrates an embodiment where there are multiple sensors 902 positioned along the overshot device 300. In this embodiment, as the tool string 200 can be swallowed by the overshot device 300, the sensors 902 detect the presence of the tool string 200 (by, for example, magnetically, or by the Hall effect, or some similar manner) at various locations during the swallowing procedure. As the tool string 200 can be successively swallowed by the overshot tool 300, the signals from each individual sensor 902 will sequentially provide a positive indication of the progression of the tool string 200 into the overshot device 300. The advantage of this embodiment is that the swallowing procedure can be monitored more closely by the operator as the sensors 902 send successive positive signals to the surface 101. Thus the operator can have a better indication of just how close the shoulder 203 of the tool string 200 can be to mating with the shoulder 604 of the overshot device 300.

It should be noted that, while FIGS. 7, 8 and 9 illustrate single sensor systems, the device disclosed herein may make use of multiple sensors, in any combination. The use of multiple sensors may be desirable in situations where the reliability of one sensor combination is not sufficient, or if lack of power in a particular borehole precludes the use of one of the sensor packages.

Figure 10:
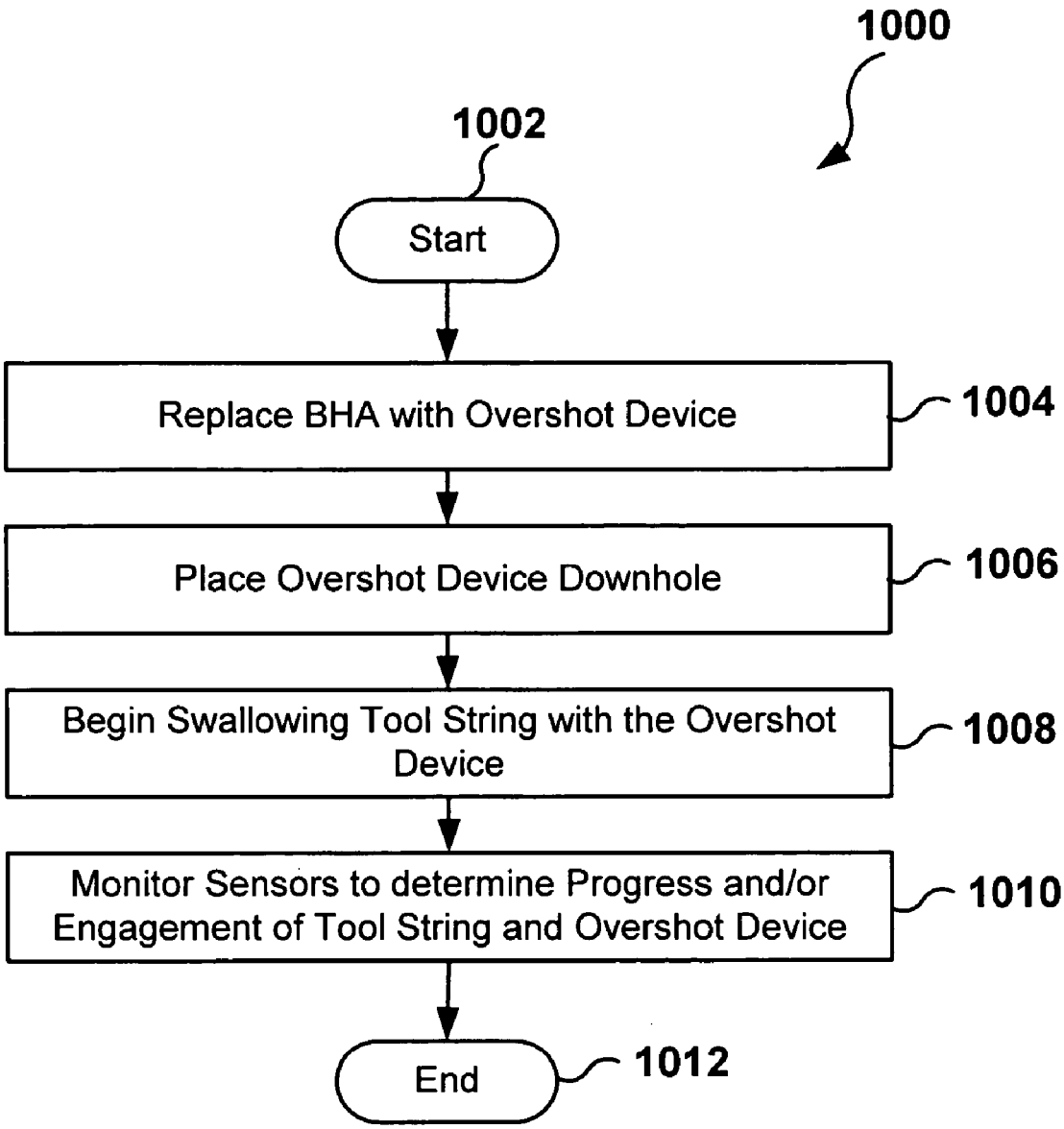
FIG. 10 is a flowchart illustrating the operation of the apparatus according to the teachings of the present disclosure.

FIG. 10 illustrates the method 1000 of using the apparatus described above. The method begins generally at step 1002. If the overshot device 300 is not already in place, the bottom hole assembly can be replaced with the overshot device 300 in step 1004. The overshot device 300 can then be placed downhole, in step 1006, in proximity to the location of the lost or stuck tool string 200. Once the overshot device 300 is in position, in step 1008, the overshot device 300 can begin swallowing the tool string 200. In step 1010, the overshot device 300 swallows the tool string 200. In one embodiment disclosed of step 1010, herein, the sensor or mechanical device that indicates positive engagement will activate only when the tool string 200 is engaged the overshot device 300 at the final position (i.e., ready to pull up to the surface 101). In other embodiments of step 1010, multiple sensors or mechanical devices on the tool string 200 and/or the overshot device 300 activate at successive (perhaps even or uneven) intervals to indicate the position of the tool string 200 within the overshot device 300 at various points along the swallowing process and the method ends generally at step 1012. The latter embodiment provides the operator with a better indication of the progress of the method disclosed herein.

Figure 11:
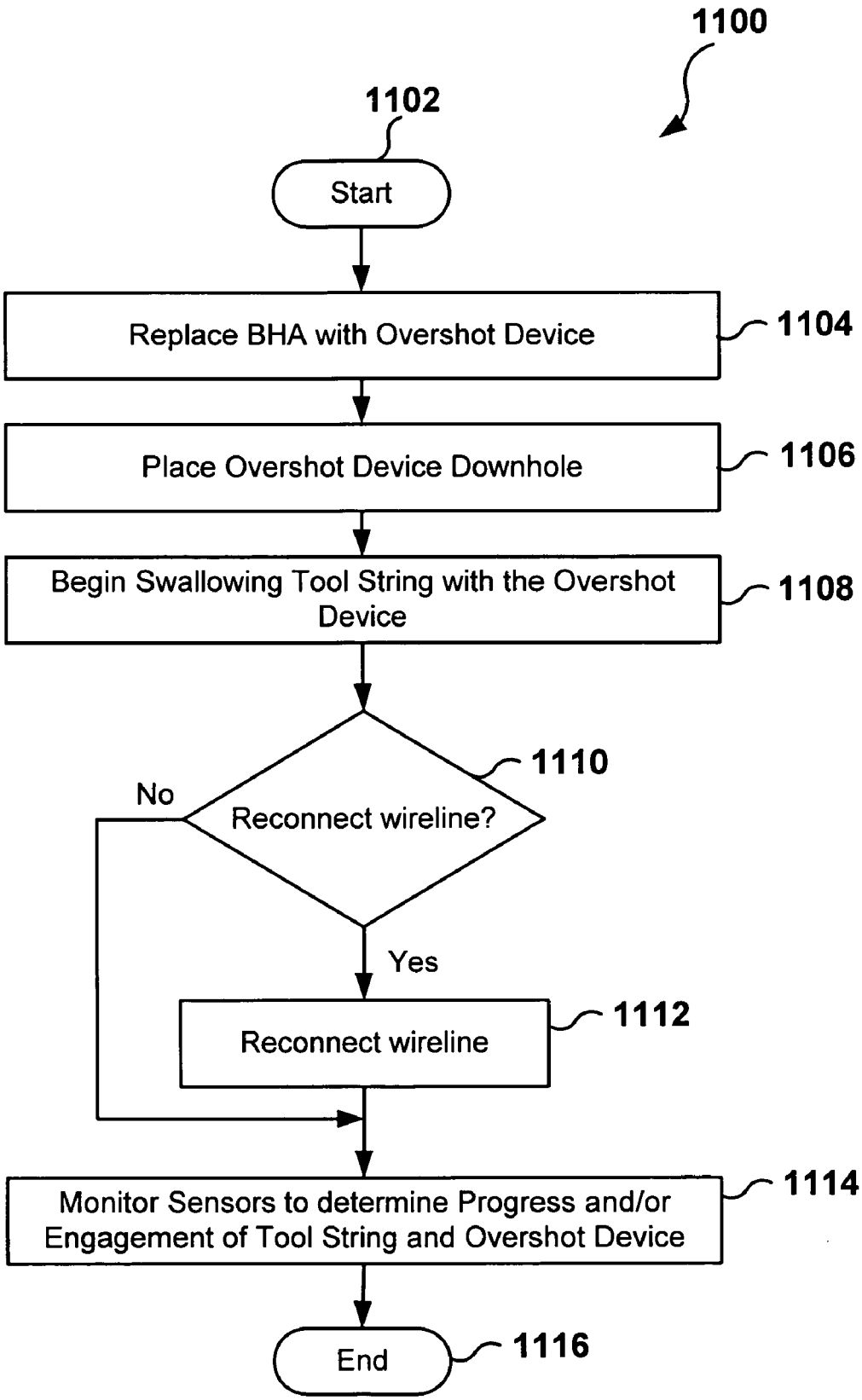
FIG. 11 is a flowchart illustrating the operation of the apparatus according to the teachings of the present disclosure.

FIG. 11 illustrates an alternate method 1100 of using the apparatus described above. The method begins generally at step 1102. If the overshot device 300 is not already in place, the bottom hole assembly can be replaced with the overshot device 300 in step 1104. The overshot device 300 can then be placed downhole, in step 1106, in proximity to the location of the lost or stuck tool string 200. Once the overshot device 300 is in position, in step 1108, the overshot device 300 can begin swallowing the tool string 200. In step 1110, a decision is made whether to reconnect the wireline. If the wireline is to be reconnected (e.g., the answer to step 1110 is "yes"), then the tool string 200 can be reconnected to the wireline in step 1112. In either case, in one embodiment of step 1114, the sensor or mechanical device that indicates positive engagement will activate only when the tool string 200 is engaged the overshot device 300 at the final position (i.e., ready to pull up to the surface 101), an activity which may be monitored by human and/or electromechanical means. In other embodiments of step 1114, multiple sensors or mechanical devices on the tool string 200 and/or the overshot device 300 activate at successive (perhaps even or uneven) intervals to indicate the position of the tool string 200 within the overshot device 300 at various points along the swallowing process and the method ends generally at step 1116. The latter embodiment provides the operator with a better indication of the progress of the method disclosed herein.

The foregoing description of the embodiments of the invention has been presented for the purposes of illustration and description. The foregoing description is not intended to be exhaustive, or to limit the invention to the precise form disclosed. Many modifications and variations are possible in light of the above teaching. It is intended that the scope of the invention be limited not by this detailed description, but rather by the claims appended hereto.

What is claimed is:

1. A positive engagement apparatus comprising:

a tool string having one or more engagement sensors selected from the group consisting of Hall effect sensors, magnetic sensors, and combinations thereof; and an overshot device;

wherein the one or more engagement sensors are activated by the overshot device swallowing a portion of the tool string.

2. The apparatus of claim 1, wherein one or more of the one or more engagment sensors is a switch.

3. The apparatus of claim 1, wherein the one or more engagement sensors include a Hall effect sensor and a switch.

4. The apparatus of claim 1, wherein the one or more engagement sensors include a switch and a magnetic sensor.

5. A positive engagement apparatus comprising:

a logging tool string; and an overshot device having one or more engagement sensors selected from the group consisting of Hall effect sensors, magnetic sensors, and combinations thereof;

wherein the one or more engagement sensors are activated by the logging tool string engaging the overshot device.

6. The apparatus of claim 5, wherein the one or more engagement sensors includes two or more Hall effect sensors.

7. The apparatus of claim 6, wherein the two or more Hall effect sensors are constructed and arranged to monitor two or more points of progress of the swallowing of the logging tool string.

8. The apparatus of claim 5, wherein the one or more engagement sensors include two or more magnetic sensors.

9. The apparatus of claim 8, wherein the two or more magnetic sensors are constructed and arranged to monitor two or more points of progress of the swallowing of the logging tool string.

10. The apparatus of claim 5, wherein the one or more engagement sensors include a Hall effect sensor and a switch.

11. The apparatus of claim 5, wherein the one or more engagement sensors include a switch and a magnetic sensor.

12. A method of engaging a logging tool string comprising:

placing an overshot device in proximity of the logging tool string;

the overshot device having one or more engagement sensors selected from the group consisting of Hall effect sensors, magnetic sensors, and combinations thereof;

swallowing the logging tool string with the overshot device; and monitoring the engagement of the logging tool string and the overshot device;

wherein monitoring the engagement only occurs during or after swallowing the logging tool string.

13. The method of claim 12, wherein the step of monitoring includes activating a sensor of the one or more engagement sensors.

14. The method of claim 12, wherein the overshot device further comprises one or more mechanical devices, and wherein the step of monitoring includes activating one of the mechanical devices.

15. The method of claim 14 wherein the step of monitoring includes activating two or more mechanical devices.

16. The method of claim 12, wherein the step of monitoring includes activating two or more sensors.

17. A method of engaging a tool string comprising:

placing an overshot device in proximity of the tool string;

swallowing the tool string with the overshot device;

determining if the tool string is to be reconnected to a wireline; and monitoring the engagement of the tool string and the overshot device.

18. The method of claim 17, wherein if the tool string is to be reconnected to the wireline, then reconnecting the tool string to the wireline.

19. The method of claim 17, wherein the step of monitoring includes activating a sensor.

20. The method of claim 17, wherein the step of monitoring includes activating a mechanical device.

21. The method of claim 17, wherein the step of monitoring includes activating two or more sensors.

22. The method of claim 17, wherein the step of monitoring includes activating two or more mechanical devices.

* * * * *